United States Patent [19]

Francis

[11] 4,141,512

[45] Feb. 27, 1979

[54] CONSTRUCTION OF A HAMMER FOR HAMMER MILL

[75] Inventor: Terry M. Francis, Niskayuna, N.Y.

[73] Assignee: Adirondack Steel Specialties, a division of Adirondack Steel Casting Co., Inc., Watervliet, N.Y.

[21] Appl. No.: 867,880

[22] Filed: Jan. 9, 1978

[51] Int. Cl.[2] ..... B02C 13/28

[52] U.S. Cl. ..... 241/194; 241/195

[58] Field of Search ..... 241/189 R, 194, 195, 241/197

[56] References Cited

U.S. PATENT DOCUMENTS

| | | | |
|---|---|---|---|
| 2,196,722 | 4/1940 | Clement | 241/197 |
| 3,367,585 | 2/1968 | Ratkowski | 241/197 |
| 3,727,848 | 4/1973 | Francis | 241/197 X |
| 3,738,586 | 6/1973 | Fabert, Jr. | 241/195 |
| 3,844,494 | 10/1974 | Hightower | 241/194 X |

*Primary Examiner*—Howard N. Goldberg
*Attorney, Agent, or Firm*—Pennie & Edmonds

[57] ABSTRACT

A hammer formed of a solid metal body of uniform thickness having a working end and a mounting end is reinforced by an increase in cross-sectional surface area at the mounting end, and provided with a channel around the mounting end and along the walls, relieved toward the longitudinal axis of the hammer, which connect the ends, both the relievement and the channel reducing the weight of the hammer remote from the working end to locate the center of mass closer to the working end.

5 Claims, 6 Drawing Figures

CONSTRUCTION OF A HAMMER FOR HAMMER MILL

BACKGROUND OF THE INVENTION

1. Field of the Invention

The present invention relates to an improvement in a hammer of the type capable of use in a heavy-duty mill for tearing or shredding ductile metal in the form of scrap automobile bodies, sheet material and the like at the end of its useful life.

2. Background of the Invention

Hammer mills which are capable of breaking and/or disintegrating materials have been in use for a number of years, as have hammer mills which are capable of shredding or tearing solid materials. The scrap produced from a shredding or tearing process had been considered in many circles as being superior to that produced from other processes, such as compressing and shearing, and the industry has endeavored to provide structures whereby the preferred scrap may be obtained. Typical of such structures is that described in U.S. Pat. No. 3,727,848 to T. M. Francis. The Francis structure includes a rotary hammer assembly including a plurality of solid metal hammers having a body formed by a mounting end and a working end connected by generally outwardly inclined walls. The hammer is generally bell-shaped. Typically, a hammer of the type of the above patent is of a weight of about 250 pounds and supplies disintegrating power upon rotation around a "hammer circle" to tear ductile material which is fed into the hammer mill. While the hammer generally has performed satisfactorily, it has been found in certain instances such as when the hammer receives blows which are not straight toward the working face, that the body will fracture within the mounting end. This occurance requires that the hammer be replaced with consequent cost of a replacement hammer and downtime of the hammer mill. A further disadvantage of the hammer of the prior art is the weight itself. As may be apparent, the hammer, normally a cast article formed of steel or the equivalent, firstly, is quite expensive and, secondly, has a short working life as may be expected from the operation to which it is subjected. Consequently, any reduction in weight of the hammer will provide a savings in cost of hammers and the overall expense of the hammer mill operation.

SUMMAY OF THE INVENTION

The present invention seeks to overcome the abovedescribed disadvantages in hammers of the prior art by both increasing its strength to resist fracture in the mounting end and by decreasing the overall weight of the hammer by a decrease in weight remote from the working end thereby to locate the center of mass of the hammer toward the working end. The hammer of the present invention is formed of a solid metal body of uniform thickness having a working end and a mounting end including a bore for mounting the hammer on a rotary hammer assembly of a hammer mill. The body is reinforced at the mounting end in planes including the axis of the bore by an increase in cross-sectional area of up to about 50% to resist fracture in the vicinity around the bore resulting from forces of impact in the wear area and, additionally, the walls connecting the ends, relieved toward the longitudinal axis of the hammer, as well as the wall of the mounting end include a continuous peripheral channel. The channel and relievement provide a reduction in the weight of the hammer remote from the working end to locate the center of mass of the hammer closer to the working end.

DESCRIPTION OF THE PREFERRED EMBODIMENT

Figure 3:
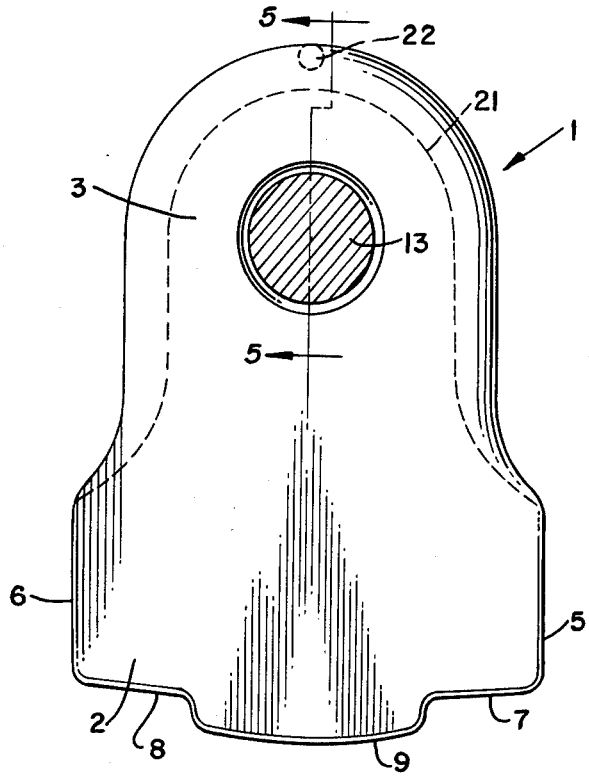
FIG. 3 is a front elevational view of the hammer of the present invention.

The hammer 1, seen to good advantage in FIG. 3, if formed by a solid body which includes a base 2 defining a working end and a mounting end 3. A bore 4 or "eye" is formed in the mounting end for purposes of mounting the hammer on a rotary hammer assembly, as will be described.

The hammer 1 is substantially uniform in thickness (see FIG. 4) and the preferred embodiment including two working edges is symmetrical along a longitudinal axis from one end of the body to the other. The hammer may be cast or otherwise formed to the outline of FIGS. 3 and 4. Preferably, the hammer will be formed of a heavy metal such as steel.

The base 2 includes two working edges, each formed in part by a sidewall 5, 6 extending generally parallel to the aforementioned axis and completed by the working surfaces 7, 8 and 9. The working surface 9 is disposed longitudinally outward of the working surface 7, 8 and connected at each end by a rounded, stepped configuration. The working surface 7, 8 connected to the sidewalls by a rounded corner may be angled slightly toward the working surface 9.

Without any intent to limit the invention to a configuration of hammer particularized by certain dimensions, but rather to exemplify a possible embodiment of the invention as well as to bring out the inventive features, the hammer 1 may be approximately 5 inches in thicknes and the working surface 9 may be disposed along the surface of a cylinder having a radius of approximately 16.5 inches described from the axis of bore 4. The sidewalls 5, 6 may be approximately 7 inches in length and the working surfaces 7, 8 may be inclined by a few degrees. The working surfaces 7, 8 may be inclined by a few degrees. The working surfaces 7,8 each are approximately 4 inches in length and the working surface 9 is approximately 8 inches in length.

It is in the construction of the mounting end 3 of the hammer 1 which causes it in one manner to distinguish from the prior art. To this end, the mounting end and paticularly the portion of the body in the vicinity of the bore 4 is reinforced thereby to better resist forces transmitted to this area from blows at the face of the working edge including components which are not directed straight against the face and which result in a turning moment of the hammer about an axis perpendicular to the axis of the bore 4. Thus, the outline of the body around the bore 4 within the mounting end 3 is increased in dimension over that of the prior art by an increase in radius from the axis of the bore 4 of about 2 inches. Again, for purposes only of exemplifying a possible embodiment of the invention, the surface of the body of increased dimensions may be at a radius of approximately 6.5 inches.

Figure 5:
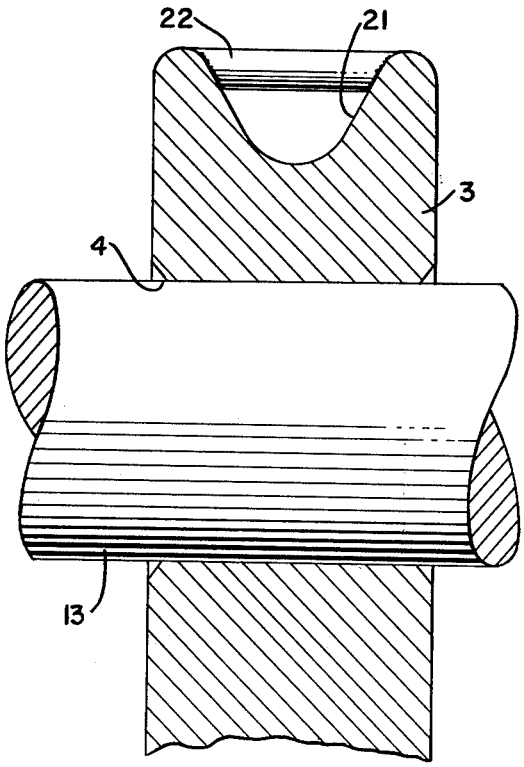
FIG. 5 is an enlarged view as seen along the line 5—5 in FIG. 3.

The increase in cross-sectional area in planes including the axis of bore 4 provides an important aspect of the invention, namely, the strengthening of the body in the vicinity of the bore to overcome forces developed by oblique blows against the face of a working edge. An additional aspect of the invention is in the overall reduction in weight of the hammer 1 and particularly a reduction of weight remote from the base or working end 2 wherein the result is that the center of mass of the hammer locates further from the axis of bore 4 along the longitudinal axis of the body toward the working end. the overall reduction in weight is provided by a relievement in the surface connecting the mounting end 3 at opposite locations of an extended diameter of bore 4 and the base 2 as well as by the provision of a channel along this surface and the surface around the mounting end. The relievement in the surfaces is such that the surfaces along substantially their length are disposed substantially parallel to the longitudinal axis of the body. As may be seen in the figures, the channel 21 terminates at the base above the opposite wear areas of the working edges. The channel may be U-shaped in cross-section (see FIG. 5). The dimensions of the channel may be such to provide an increase in cross-sectional area of from about 35 to about 50% for purposes set out above and together with the relievement in the surface to decrease the weight of the hammer by about 20% or more.

Figure 1:
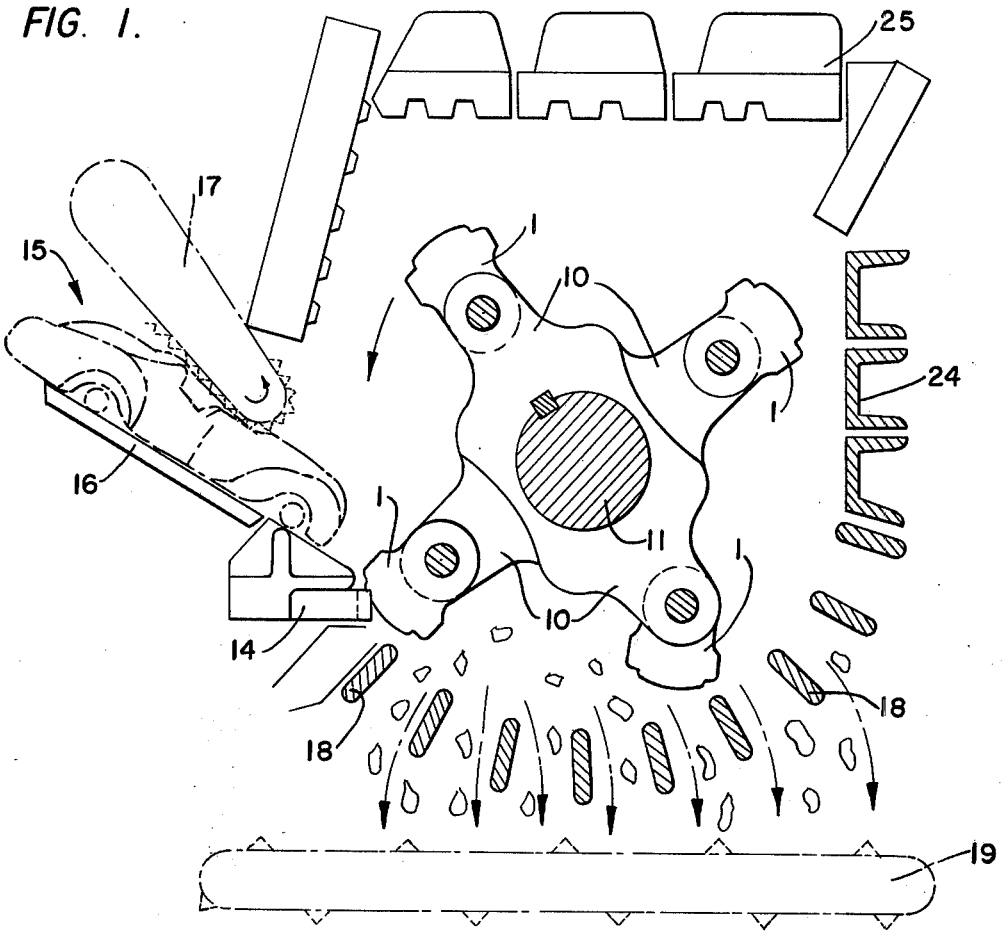
FIG. 1 is a vertical sectional view through a hammer mill embodying the invention.
Figure 2:
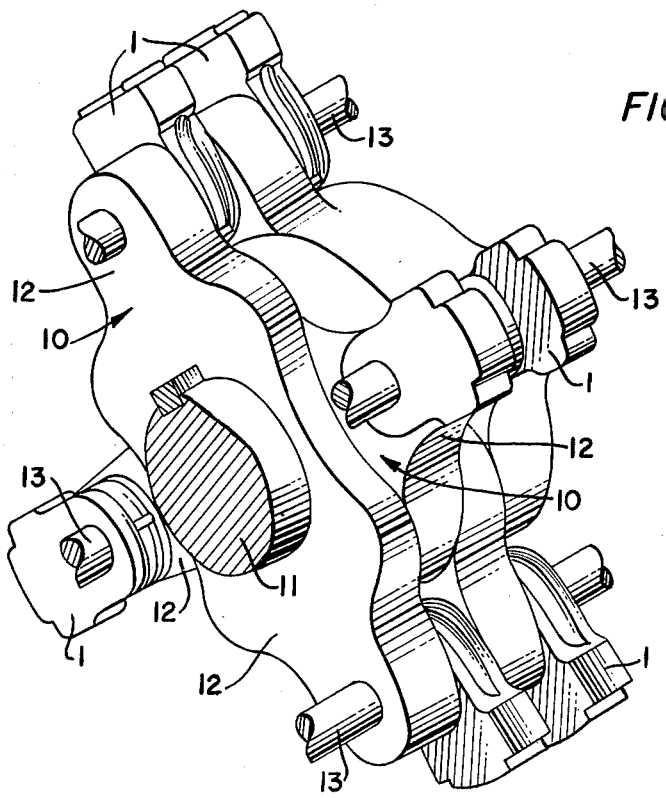
FIG. 2 is a perspective view of a portion of the rotary hammer assembly of the hammer mill.

The hammer 1 comprises a part of a rotary hammer assembly of a hammer mill, such as illustrated in FIG. 1. The rotary hammer assembly (see FIG. 2) comprises a series of spiders 10 mounted on a shaft 11. The spiders are keyed or otherwise secured to the shaft for conjoint movement with the shaft driven by a motor (not shown). Each spider (see FIG. 2) includes two pairs of diametrically opposite arms 12. The arms are axially offset and the arms of each spider are disposed normal to the other. Thus, the circumferentially adjacent arms of adjacent spiders being spaced apart provide an opening into which a hammer may be received for support by the spiders. To this end, each arm formed with a bore in alignment with the bore of each circumferentially adjacent arm and a shaft 13 is received through the aligned bores. As may be seen in FIG. 2, the hammers are carried by a respective shaft and spaced at intervals of about 90°. If the spacing or opening into which the hammer is received is in excess of the thickness of the hammer, suitable bushings may be received on the shaft 13 to reside beween the hammers and the adjacent arms.

Each of the hammers is mounted on its shaft 13 in a manner to permit free swinging movement in the event, for example, that the hammer strike relatively unyielding material which resists tearing. One of the hammers (see FIG. 1) has swung about its mounting axis; whereas, the other hammers under contrifugal force acting thereon are illustrated as residing in a radially outward disposition. In this operation, the hammers perform as though they were rigidly secured to the arms 12.

Generally, in rotation, counterclockwise in FIG. 1, the individual hammers coact with the ductile material fed into the hammer mill along a bar 14 which may, as desired, include a serrated edge providing a comb outline. The bar is mounted rigidly at the base of an inlet chute 15 formed by an inclined surface 16 and an upper feeding conveyor 17. The individual hammers also coact with the ductile material along a series of grate bars 18 circumferentially spaced around the bottom of the hammer mill and slightly outwardly of the "hammer circle". This coaction serves to tear the ductile material which, in fragmented form, falls by gravity through the openings in the grate bars. The material is conveyed from the hammer mill by a conveyor 19. It should also be apparent that the hammer of the present invention is capable of application in hammer mills of the top discharge type (not shown). In this type of a hammer mill, there is an imperforated liner which tranverse between the bar 14 and the vertical wall 24 and the portion of the top wall 25 (see FIG. 1), which may comprise about one-half of its length, is formed by a grate. The grate may be similar to the grate 18 and shredded ductile metal may exit the hammer mill through action of the hammer in rotation. The shredded ductile metal will impinge against an inclined surface to change the direcion of movement of the ductile metal which then falls by gravity upon a conveyor such as the conveyor 19 located laterally of the hammer mill.

Figure 4:
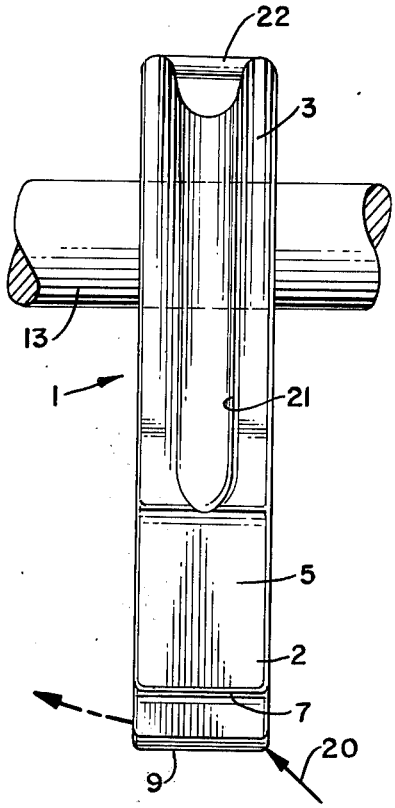
FIG. 4 is a side elevational view of the hammer of FIG. 3.

In operation of the hammer mill, it may be apparent that the working area of each hammer may coact with ductile material to be ripped such that the blows may include components of force which are not straight against the face, such as along the line of the arrow 20 (see FIG. 4). Oblique blows on the face at the working area of the hammer result in a turning moment of the hammer about an axis normal to the axis of shaft 11. However, the reinforcement and strengthening of the mounting end of the hammer by the increase in cross-sectional surface area in planes including the axis of bore 4 by about 35% to about 50% has been found to significantly reduce the occurrance of fracture of the body caused by oblique blows to the face at the working end. The fact that the surface connecting the base 2 and the mounting end 3 has been relieved has been found to have no appreciable effect on the strength of the mounting end in the vicinity of the bore 4 since the area adjacent this surface has significant strength characteristics. Thus, the relief in the surface and the channel provide the overall reduction in weight of the hammer remote from the working end or base while retaining the weight in the base or working end such that the center of mass of the hammer will locate closer to the base. Accordingly, the hammer will better resist a swinging movement about the shaft 13 since it will exert a blow of greater force on the ductile material to be torn.

The working area of the hammers may track a "hammer circle" of any particular diameter. Typically, hammer mills are capable of providing a "hammer circle" of, for example, 6 feet, 8 feet, or 10 feet from the tips of opposite hammers and to obtain a speed of about 14,000 - 15,000 ft/min the motor may drive the spider 10 at a speed of about 720, 600, or 450 rpm.

Figure 6:
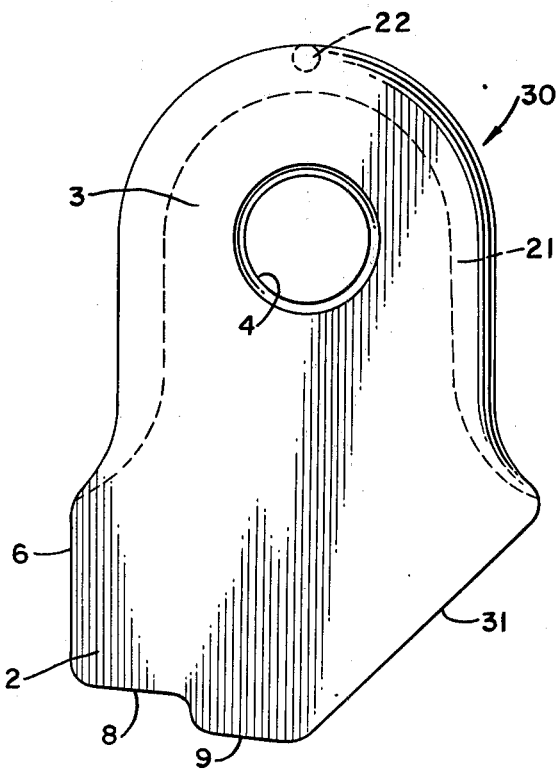
FIG. 6 is a front elevational view of a further form of hammer.

The present invention is equally applicable to a hammer 30 (see FIG. 6) having only a single working edge. The hammer 30 duplicates the hammer 1 except that the body includes a surface 31 between the relieved surface of the mounting end 3 and the working surface 9. As may be appreciated, the one-edge hammer will be equal in throw-away weight to that of the two-edged hammer after two uses, yet it may provide some benefit in initial cost of material as well as in the cost of down-time of the hammer mill as required for changing and balancing the two-edged hammer after the first use. A cross-member 22 connecting opposite sides of the channel 21 may be grasped by a grappling hook or the equivalent to permit handling of the hammer.

The rotary hammer assembly and the hammer mill other than providing a mounting for the hammers as described above forms no part of the present invention and may be considered conventional.

Having described the invention with particular reference to the preferred form thereof, it will be obvious to those skilled in the art to which the invention pertains after understanding the invention, that various changes and modifications may be made therein without department from the spirit and scope of the invention as defined by the claims apended hereto.

Having described the invention, what is claimed is:

1. A hammer of the type adapted for use in a hammer mill for tearing ductile metal comprises (a) a body having (1) a base defining a working end, said working end having at least one working edge, (2) a mounting end including a bore substantially equidistantly spaced from the surface of the body by a reinforced cross-section, said bore adapted for mounting the body and, (3) a surface connecting opposite sides of said mounting end and said base, said connecting surfaces along substantially their length disposed substantially parallel with an axis through the body; and, (b) a channel formed in said body along said connecting surfaces and around said mounting end, said channel and relieved connecting surfaces functioning to reduce the weight of said body in the portion removed from said base to locate the center of mass closer to said base.

2. The hammer of claim 1 wherein said channel is U-shaped in cross-section and disposed in the region midway between a front and rear surface of said body.

3. The hammer of claim 2 wherein said body is symmetrical about said axis.

4. In combination with a rotary hammer assembly of a hammer mill for tearing ductile metal, a hammer comprising (a) a body having (1) a base defining a working end, said working end having at least one working edge, (2) a mounting end including a bore substantially equidistantly spaced from the surface of the body by a reinforced cross-section, said bore adapted for mounted the body and, (3) a surface connecting opposite sides of said mounting end and said base, said connecting surfaces along substantially their length disposed substantially parallel with an axis through the body; and, (b) a channel formed in said body along said connecting surfaces and around said mounting end, said channel and relieved connecting surfaces functioning to reduce the weight of said body in the portion removed from said base to locate the center of mass closer to said base.

5. A hammer of the type adapted for use in a hammer mill for tearing ductile metal including a body having a base providing at least one working edge, a dome-shaped mounting end including a bore for mounting said body and a surface connecting opposite sides of said base and mounting end, and wherein the improvement includes said connecting surfaces along substantially their length disposed toward an axis of said body and a channel extending around said mounting end to said base, said channel and the contour of side connecting surfaces functioning to reduce the weight of said body within the portion between said base and mounting end to locate the center of mass closer to said base.

* * * * *

UNITED STATES PATENT AND TRADEMARK OFFICE

CERTIFICATE OF CORRECTION

PATENT NO. : 4,141,512

DATED : February 27, 1979

INVENTOR(S) : Terry M. Francis

It is certified that error appears in the above-identified patent and that said Letters Patent are hereby corrected as shown below:

Column 2, line 21, "if" should be --is--.

Column 2, line 48, "thicknes" should be --thickness--

Column 3, line 17, "the" should be --The--.

Column 3, line 60, "contrifugal" should be --centrifugal--.

Column 5, line 17, "apended" should be --appended--.

Column 6, line 15, "mounted" should be --mounting--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*